US006241096B1

(12) United States Patent
Littlejohn et al.

(10) Patent No.: US 6,241,096 B1
(45) Date of Patent: Jun. 5, 2001

(54) DISPOSABLE SERVINGWARE WITH NESTING RESISTANT FLANGE PATTERNS

(75) Inventors: Mark B. Littlejohn, Appleton; Anthony J. Swiontek, Neenah, both of WI (US); Wayne W. Lamson, Beaverton, MI (US)

(73) Assignee: Fort James Corporation, Deerfield, IL (US)

( * ) Notice: Subject to any disclaimer, the term of this patent is extended or adjusted under 35 U.S.C. 154(b) by 0 days.

(21) Appl. No.: 09/335,639

(22) Filed: Jun. 18, 1999

(51) Int. Cl.[7] ..... A47G 19/02; A47G 19/03; B65D 21/032

(52) U.S. Cl. ..... 206/515; 206/503; 206/519; 220/574

(58) Field of Search ..... 206/499, 501, 206/505, 507, 509, 513, 514, 519; 220/574, 575, 574.1, 574.3; D7/545, 585, 546, 553.1–553.8, 500, 550.1

(56) References Cited

U.S. PATENT DOCUMENTS

| | | | |
|---|---|---|---|
| D. 41,986 | | 12/1911 | Smith . |
| D. 51,874 | | 3/1918 | Beyrand . |
| D. 61,248 | | 7/1922 | Reizenstein . |
| D. 66,556 | | 2/1925 | Cunningham . |
| D. 76,433 | | 9/1928 | Tams . |
| D. 86,627 | | 3/1932 | Newton . |
| D. 88,688 | | 12/1932 | Thompson . |
| D. 103,599 | | 3/1937 | Ruck . |
| D. 106,554 | | 10/1937 | Wilson . |
| D. 109,494 | | 5/1938 | Leigh . |
| D. 116,789 | | 9/1939 | Barbiers . |
| D. 116,790 | | 9/1939 | Barbiers . |
| D. 135,030 | | 2/1943 | Harshman . |
| D. 140,345 | | 2/1945 | Fordyce . |
| D. 164,669 | | 10/1951 | Chaplin . |
| D. 169,133 | | 3/1953 | Foster . |
| D. 179,011 | | 10/1956 | Kimble . |
| D. 188,502 | | 8/1960 | Metzler et al. . |
| D. 190,336 | | 5/1961 | Denni et al. . |
| D. 221,290 | | 7/1971 | Wiedemann . |
| D. 232,613 | | 9/1974 | Cheladze . |
| D. 250,928 | | 1/1979 | Franklin . |
| D. 251,713 | | 5/1979 | Brody . |
| D. 275,255 | | 8/1984 | Durand . |
| D. 276,117 | | 10/1984 | Solt . |
| D. 279,345 | | 6/1985 | Durand . |
| D. 316,800 | | 5/1991 | Wertheim . |
| D. 342,186 | | 12/1993 | Frere . |
| D. 348,804 | | 7/1994 | Feer . |
| D. 351,316 | | 10/1994 | Mann . |
| D. 351,968 | | 11/1994 | Zivin . |
| D. 354,884 | | 1/1995 | Carranza . |
| D. 364,537 | | 11/1995 | Anderson . |
| D. 386,048 | | 11/1997 | Bebaway . |
| D. 434,604 | * | 12/2000 | Littlejohn et al. ..... D7/545 |
| D. 434,605 | * | 12/2000 | Littlejohn et al. ..... D7/546 |
| 1,440,070 | | 12/1922 | Fry . |
| 1,786,733 | * | 12/1930 | Benoit ..... 220/380 |
| 1,813,810 | * | 7/1931 | McDonald et al. ..... 206/519 |
| 1,848,066 | | 3/1932 | Shepard et al. . |
| 2,928,567 | | 3/1960 | Davis . |
| 3,001,665 | | 9/1961 | Tomarin . |
| 3,672,538 | | 6/1972 | Wiedemann et al. . |
| 3,675,811 | | 7/1972 | Artz . |

(List continued on next page.)

*Primary Examiner*—Allan N. Shoap
*Assistant Examiner*—Niki M. Eloshway
(74) *Attorney, Agent, or Firm*—Michael W. Ferrell

(57) ABSTRACT

Stackable servingware is provided with repeating flange patterns configured to resist nesting and taper lock. The patterns include a first pattern which is chiral with respect to a second pattern such that the patterns are not superimposable on one another. Preferably, the servingware is packaged in alternating sequence such that each article in a stack has a flange pattern which mirrors the flange pattern of adjacent articles.

46 Claims, 6 Drawing Sheets

U.S. PATENT DOCUMENTS

| | | | | |
|---|---|---|---|---|
| 3,809,236 | * | 5/1974 | Davis et al. | 206/519 |
| 3,931,890 | | 1/1976 | Davis . | |
| 4,734,450 | | 3/1988 | Kawai et al. . | |
| 4,809,876 | | 3/1989 | Tomaswick et al. . | |
| 4,933,526 | | 6/1990 | Fisher et al. . | |
| 4,981,631 | | 1/1991 | Cheung et al. . | |
| 5,023,286 | | 6/1991 | Abe et al. . | |
| 5,045,369 | | 9/1991 | Kobayashi et al. . | |
| 5,088,640 | | 2/1992 | Littlejohn . | |
| 5,165,978 | | 11/1992 | Lecinski . | |
| 5,300,747 | | 4/1994 | Simon . | |
| 5,377,860 | | 1/1995 | Littlejohn et al. . | |
| 5,439,628 | | 8/1995 | Huang . | |
| 5,622,780 | | 4/1997 | Paleari . | |
| 5,665,442 | | 9/1997 | Andersen et al. . | |
| 5,758,773 | | 6/1998 | Clements . | |
| 6,100,512 | * | 8/2000 | Neculescu et al. | 219/725 |

* cited by examiner

DISPOSABLE SERVINGWARE WITH NESTING RESISTANT FLANGE PATTERNS

TECHNICAL FIELD

The present invention relates generally to disposable servingware products and more specifically to disposable servingware with flange patterns configured to prevent nesting and/or taper lock.

BACKGROUND

It is commercially useful to have food service products such as plates, bowls, trays, and the like which have a shelf package presence that conveys to the consumer the key product features including style/design, color, thickness, texture and strength. Shelf package presence can be obtained through enhanced or greater height packaged product. A greater height also provides more area on the side of the package for printing the product name, description and advertising. Consistent spacing of products within each package is likewise necessary to obtain consistent package dimensions and to provide for desirable uniformity.

It is additionally desirable to have food service products which are easy to separate and dispense from the stack whether the article is a plate, bowl, tray, cup or lid and so forth. Disposable products are often produced from lower caliper materials. Spacing between products within a stack, resulting from the caliper alone would be minimal and not overcome the difficulty for the consumer to separate and dispense the product.

Spacing features have been incorporated into product design to increase and enhance the spacing between products to improve dispensability as well as to prevent so called "taperlock" wherein the sidewalls of articles are stuck together. These spacing features must be designed in such a manner that they do not nest on top of each other and thus negate their intended function. In other words, in a nested configuration of two articles, the relief patterns merely overlap each other and do not provide spacing between the articles. Spacing features, which heretofore are sometimes called "separation lugs" are often very utilitarian in nature and can detract from the overall product design and aesthetics. The present invention is directed to a method to obtain consistent, enhanced spacing on products that have symmetrical flange patterns with varying heights without using such separation lugs. The inventive patterns overcome the drawbacks of the prior art.

U.S. Pat. No. 3,672,538 to Wiedemann is directed to a disposable dish which can be stacked together with similar dishes but can easily be removed from the stack on an individual basis. The dish can be a plate, a saucer or a bowl (Col. 1, lines 13–16 and lines 57–59) and is composed of a thin sheet of a relatively rigid, semi-flexible material such as plastic, or a rigid paper (Col. 1, lines 7–9). The disposable dish has a central portion and a rim around the edge of the central portion. The rim has a plurality of special upstanding ribs which space the dishes slightly apart when the dishes are stacked together so as to facilitate separating the dishes (Col. 1, lines 39–43). The ribs are circumferentially spaced on the rim (Col. 2, lines 6–8); the rim of the dish has a pattern embossed thereon (Col. 2, lines 8–9). The ribs are part of the pattern that is larger than the other portions of the pattern as to stand up higher from the rim. When a plurality of these dishes are stacked together, the ribs engage the under surface of the rim of the next upper dish so as to slightly space the dishes apart, thereby preventing the dishes from nesting together and allowing for ease of removing individual dishes from the stack (Col. 2, lines 16–21). Preferably the ribs are non-uniformly spaced apart around the rim so as to greatly minimize the chances of the ribs on one dish meeting or fitting into the ribs of the next dish (Col. 2, lines 13–15 and lines 21–24).

U.S. Pat. No. 5,758,773 to Clements discloses molded plastic plates having a rolled edge rim, wherein the plates are premolded with lugs that project outwardly from the sides of the plate. The lugs of one plate contact the rim of the next successive plate in a stack of plates to create a gap between the plates stacked on top of one another. The gap allows the top plate in the stack to be easily picked up and separated from the remaining plates in the stack (Col. 3, lines 49–51). The lugs are spaced around the circumference of the plate (Col. 3, lines 61–62). The lugs of each successive plate are slightly offset from the corresponding lugs of the plates stacked immediately above it in order to prevent the lugs of the top plate from locking inside the lugs of the plate underneath it, thereby losing the gap between the plates (Col. 3, lines 62–66). One method of offsetting the lugs is to mold the plates from several different molds, each mold having the lug spaced at slightly different intervals (Col. 4, lines 1–4).

U.S. Pat. No. 3,931,890 to Davis is directed to disposable, thin walled, plastic lids having a stacking facility which cooperates with other similar lids to form a stable lid stack and to prevent jamming when axial loads are applied to them (Col. 1, lines 5–9). The lids are preferably formed in groups in which some of the lids of the group have projections which are of different angular spacing than the projections on other lids in the group (Col. 2, lines 23–26). Such lids are stacked in alternating sequence which ensures that the stacked lids will be mismatched and therefore will not become jammed (Col. 2, lines 26–29). The lids are designed to be made by conventional thermoforming techniques (Col. 3, lines 21–23).

U.S. Pat. No. 5,165,978 to Lecinski is directed to closure panels with flute or rib means which prevent nesting when a plurality of the closure panels (for bottle caps) are stacked (Col. 1, lines 12–15). Preferably the closure panels are formed in a multiple cavity die with each cavity having a different flute arrangement such that when the closure panels are rotated so that certain other flutes align with each other, not all flutes will be in alignment (Col. 1, lines 42–50).

SUMMARY OF THE INVENTION

There is provided in accordance with the present invention an ensemble of stackable servingware configured to resist nesting and taper lock. In a particularly preferred embodiment the collection of articles includes a first article with a relief pattern in basket-like form of varying height around the flange of the article. A second article has a relief pattern which is a mirror image of the relief pattern of the first article wherein the height of the relief pattern around the flange varies in the opposite direction of the height variation of the first article. In other words, if the height of the first flange pattern of the first article varies from high to low in a clockwise direction, the height variation in the second flange pattern of the second article varies from high to low in a counterclockwise direction. The shape of the pattern is also symmetrical about radial lines about the flange and therefore the size, spacing and angular relationship between the two different bowls, plates, trays or the like, may be expressed as being such that the pattern of the second plate chirally mirrors the pattern of the first plate. The invention is most advantageously utilized wherein each article in a stack has a relief pattern which chirally mirrors the relief pattern of the adjacent article.

Chirality is commonly used to denote objects that are mirror images of each other yet are not superimposable on one another, like the right and left hand. As used herein, the terminology "chiral", "chirally mirroring" and similar terms includes objects and features which are generally mirror images of each other yet are not superimposable on one another as well as objects that appear similar yet are not superimposable. An example of this latter case is two plates with relief patterns which are mirror images of each other except that one plate has a relief pattern which varies in height from 25 to 300 percent of the plate caliper while the second plate has a relief pattern which varies in height from 50 percent to 125 percent of the plate caliper. So also, if two plates have flange relief patterns which are not precisely mirror images in the plane of the flange, yet have relief heights with angular relationships which mirror each other, for example, clockwise versus counterclockwise increase in relief height, the plates are said to chirally mirror each other within the meaning of the term as used herein. As will become apparent from the discussion and examples which follow, it is not necessary that all aspects of the relief patterns of the two different stackable objects chirally mirror each other, the more important portions of the pattern are those located inwardly on the upwardly projecting sidewalls of the articles. The most preferred case is perhaps where the two stackable articles chirally mirror each other in every respect, that is, both in two dimensional pattern and relief height, and also when such articles are placed in alternating sequence in a stack; that is, when each article in a stack has a relief pattern which chiraly mirrors the relief pattern of the adjacent article or articles in the stack.

The present invention may be expressed in a first aspect as an ensemble of stackable servingware including at least a first and second serving article each of which serving articles is of substantially the same size and shape and each of which includes a central planar portion provided with an upwardly projecting sidewall at the periphery of said central portion and a flange portion projecting outwardly from the sidewall and each of which is provided with a relief pattern of varying height. The first article is provided with a first repeating flange relief pattern comprising a plurality of first relief design elements of varying relief height, the plurality of first relief design elements being two-dimensionally symmetrical about a plurality of radial lines about the first article bisecting the first relief design elements. The second article is provided with a second repeating flange relief pattern comprising a plurality of second relief design elements of varying relief height, the second relief design elements being two-dimensionally symmetrical about a plurality of radial lines about the second article bisecting the second relief design elements. The relief patterns are positioned, configured and dimensioned such that the second repeating relief pattern chirally mirrors the first repeating relief pattern.

Stated another way, in another aspect, the present invention is directed in a particularly preferred embodiment to an ensemble of stackable servingware including at least a first and second serving article, each of which serving articles is of substantially the same size and shape and each of which includes a central plane or portion provided with an upwardly projecting sidewall at the periphery of the central portion and a flange portion projecting outwardly from the sidewall. The first article is provided with a first repeating flange relief pattern including a plurality of first relief arcs, each of which first relief arcs include a first extremity relief portion and a second extremity relief portion. The first extremity relief portions extend inwardly at least partially into the sidewall of the first article and define a first relief height. The second extremity relief portions extend inwardly at least partially into the sidewall of the first article and define a second relief height substantially less than the first relief height of the first extremity portions of the first relief arcs of the first article.

The first and second extremity relief portions of the arcs are symmetric to each other about a plurality of first radial lines about the article bisecting the distances therebetween. The first extremity relief portion is angularly disposed towards the first radial lines in a clockwise direction and the second extremity relief portion is angularly disposed towards the first radial lines in a counterclockwise direction. The first relief arcs are dimensioned and repeated to intersect each other so as to appear as an interwoven basket-like relief pattern. To this end, the relief elements are varying height over their length.

The second article in the ensemble is provided with a second repeating flange relief pattern including a plurality of second relief arcs each of which second relief arcs include a third relief portion and a fourth extremity relief portion. The third extremity relief portions extend inwardly at least partially into the sidewall of the second article and define a third relief height. The fourth extremity relief portions extend inwardly at least partially into the sidewall of the second article and define a fourth relief height substantially greater than the third relief height of the third extremity portion of the second relief arc of the second article.

The third and fourth extremity relief portions of the arcs are symmetric to each other about a plurality of second radial lines about the article bisecting the distance therebetween, the third extremity relief portion being angularly disposed towards the second radial lines in a clockwise direction, the fourth extremity relief portion being angularly disposed towards the second radial lines in a counterclockwise direction. The relief arcs are dimensioned and repeated to intersect each other so as to appear as an interwoven basket-like relief pattern.

As will be understood, the invention may be stated more generally as an ensemble of stackable servingware including at least a first and second serving article each of which serving articles is substantially the same size and shape and each of which includes a central planar portion provided with an upwardly projecting sidewall at the periphery of the central portion and a flange portion projecting outwardly from the sidewall. The first article is provided with a first repeating relief pattern including a plurality of first arcuate design elements; each of the first arcuate design elements including a first terminal relief segment and a second terminal relief segment. The first terminal relief segments extend inwardly at least partially into the sidewall of the first article and defines a first relief height. The second terminal relief segments extend inwardly at least partially into the sidewall of the first article and define a second relief height substantially different from the first relief height of the first terminal relief segments of the first design element of the article.

The first and second terminal relief segments are angularly disposed with respect to a plurality of first radial lines about the first article bisecting the distance between the first and second terminal segments of the first design elements of the first article and the first arcuate design elements are symmetric about the first radial lines.

The second article is provided with a second repeating flange relief pattern including a plurality of second arcuate design elements, each of the second arcuate design elements including a third terminal relief segment and a fourth terminal relief segment. The third terminal relief segments extend inwardly at least partially into the sidewall of the second article and defines a third relief height. The fourth terminal relief segments extend inwardly at least partially into the sidewall of the second article and define a fourth relief height substantially different from the third relief height of the third terminal segments of the second design elements of the second article.

The third and fourth terminal segments are angularly disposed with respect to a plurality of second radial lines about the second article bisecting the distance between the third and fourth terminals segments of the second arcuate design elements of the second article and the arcuate design elements are symmetric about the second radial lines. The second arcuate design elements of the second repeating relief pattern of the second serving article chirally mirror the spacing, angular and height relationships of the first arcuate design elements of the first repeating flange relief pattern of the first serving article.

Stated still more generally, the various features of the present invention may take a variety of pattern forms other than arcs or arcuate designs so long as the following features are included.

There is provided in an ensemble of stackable servingware at least a first and second serving article, each of which serving articles is of substantially the same size and shape and each of which includes a central planar portion provided with an upwardly projecting sidewall at the periphery of the central portion and a flange portion projecting outwardly from the sidewall. The first article is provided with a first repeating flange relief pattern including a plurality of first design elements, each of the first design elements including a first terminal relief segment and a second terminal relief segment. The first terminal relief segments extend at least partially into the sidewall of the first article and define a first relief height. The second terminal relief segments extend at least partially into the sidewall of the first article and define a second relief height substantially different from the first relief height of the first terminal segment of the first design element of the first article.

The first and second terminal segments are angularly disposed with respect to a plurality of first radial lines about of the first serving article bisecting the distance between them. They are also symmetric to each other about the first radial lines.

The second article is provided with a second repeating flange relief pattern including a plurality of second design elements each of the second design elements including a third terminal relief segment and a fourth terminal relief segment. The third terminal relief segments extend at least partially into the side wall of the second article and define a third relief height. The fourth terminal relief segments extend at least partially into the sidewall of the second article and define a fourth relief height substantially different from the third relief height of the third terminal segment of the second design elements of the second article.

The third and fourth terminal segments are angularly disposed with respect to a plurality of second radial lines about the second article bisecting the distance between the third and fourth terminal segments of the second design elements of the second article and are also two dimensionally symmetric to each other about the second radial lines. The third and fourth terminal segments of the second repeating relief flange pattern of the second servingware article chirally mirror the spacing, angular and height relationships of the first and second terminal segments.

The invention relief patterns are shown debossed on and about the flanges of various articles in the examples which follow. This particular mode of application in no way limits the invention. One of skill in the art will readily appreciate that the patterns in accordance with the present invention may likewise be embossed.

BRIEF DESCRIPTION OF THE DRAWINGS

The invention is described in connection with the various drawings, in which.

DETAILED DESCRIPTION

Figure 1:
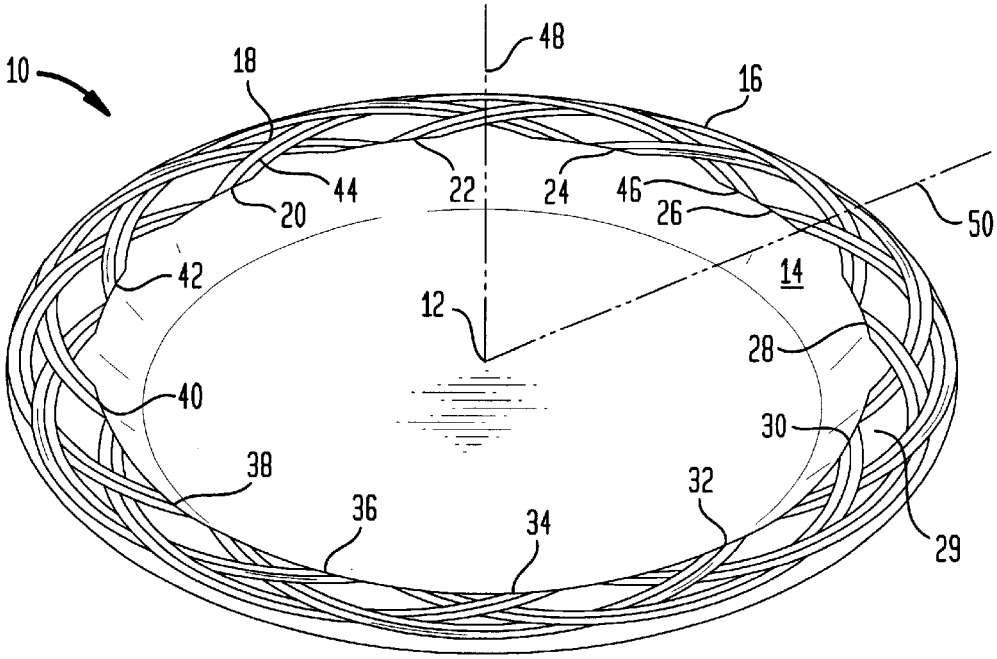
FIG. 1 is a perspective view of a disposable plate provided with a flange relief pattern in accordance with the invention.

The invention is described in detail below with reference to the Figures and examples. Such exemplification is for purposes of illustration only and is not intended to limit in any way the spirit and scope of the present invention which isset forth in the appended claims. The present invention is directed to an ensemble of stackable servingware including first and second serving articles such as bowls or plates which are of substantially the same size and shape. These articles of manufacture may also be square or rectangular in shape having angular corners, such as found in a tray. Further, additional shapes such as triangular, multi-sided, polyhexal, etc., are contemplated including compartmented trays and plates as well as oval platters. In such instances, radial lines referred to herein would be lines perpendicular to the flange portion of the articles. Such articles include a central planar portion provided with an upwardly projecting sidewall at the periphery of the central portion and a flanged portion directed outwardly from the sidewall. Preferably, the articles are disposable articles.

Generally, the first article is provided with a first repeating flange relief pattern made up of a plurality of first relief design elements of varying relief height. This first plurality of relief design elements are two-dimensionally symmetrical about radial lines about the first article bisecting the elements of the first relief design.

The second article is provided with a second repeating flange pattern made up of a plurality of second relief design elements of varying relief height. The second design elements are also two-dimensionally symmetrical about radial lines about the second article bisecting the second relief design elements.

The relief patterns are configured such that the relief pattern of the second article is a mirror image of the flange relief pattern of the first article; however, the patterns are not three-dimensionally superimposable on one another and accordingly may be said to chirally mirror each other. Conceptually this may be thought of as a right hand and left hand which are mirror images but not superimposable on each other. This is a property of the present invention wherein the patterns and thus the articles are not three-dimensionally superimposable in order to prevent nesting and taper lock of the articles in a stack. The inventive flange patterns are thus operable to provide spacing between adjacent articles when alternated in a stack, that is, where the flange pattern of an article chirally mirrors the flange pattern of the adjacent article or articles.

In general the articles of the present invention have a wall caliper of from about 10 to about 80 mils. Wall calipers of 5 to 50 mils are more common, with thicknesses from about 10 mils to 35 mils or 12.5 to 25 mils being preferred. The relief patterns generally have a relief height from about 0.25 to about 3.00 times the wall caliper of the articles, with from about 0.5 to about 2 being more common.

In particularly preferred embodiments of stackable articles, the articles have a wall caliper of about 20 mils and the relief pattern varies in height from about 0.025 to about 0.0125 inches, or from about 0.035 to about 0.0125 inches.

Particularly preferred materials for making the plates according to the present invention include relatively rigid paper and plastics as is well known. When a plastic composition is used, particularly preferred plastics are polystyrene compositions or polypropylene compositions. The polypropylene compositions may be mineral-filled. Particularly preferred embodiments may include mica-filled polypropylene compositions.

The inventive articles of the present invention may also be described, in some embodiments, as a ensemble of stackable servingware including at least a first and second serving article, each of which serving articles is substantially the same size and shape and each of which includes a planar portion provided with an upwardly projecting sidewall at the periphery of the central portion and a flanged portion projecting outwardly from the sidewall. The first article is provided with a first repeating flange relief pattern including a plurality of first arcuate design elements each of which first arcuate design elements include a first terminal relief segment and a second terminal relief segment. The first terminal relief segments extend inwardly at least partially into the sidewall of the first article and define a first relief height. The second terminal relief segments extend inwardly at least partially into the sidewall of the first article and define a second relief height substantially different from the first relief height of the first terminal segment of the first design element of the first article. The first and second terminal design segments are angularly disposed with respect to a plurality of first radial lines about the first serving article bisecting the distance between the first and second terminal segments of the first design elements of the first article. The first arcuate design elements are symmetric about these first radial lines as is illustrated and described in connection with FIG. 1 below.

The second article is also provided with a repeating flange relief pattern including a plurality of second arcuate design elements, each of the second arcuate design elements including third and fourth terminal relief segments. The third terminal relief segments extend inwardly at least partially into the sidewall of the second article and define a third relief height; while the fourth terminal relief segments extend at least partially into the sidewall of the second article and define a fourth relief height substantially different from the third relief height of the third terminal segment of the second design elements of this second article. The third and fourth terminal segments are angularly disposed with respect to second radial lines about the second article bisecting the distance between the third and fourth terminal segments of the second arcuate design elements of the second article. The second arcuate design elements are symmetric about these second radial lines. The first and second arcuate design elements of the second repeating flange relief pattern of the second article chirally mirror the spacing, angular and height relationships of the first arcuate design elements of the first repeating flange relief pattern of the first article.

In particularly preferred designs the repeating relief patterns of the first and second article include a series of overlapping arcuate design elements configured to appear as an over/under basket-weave design. In such embodiments, the arcuate design elements repeat from about 6 to about 24 times around the flange. A pattern of this type typically includes from about 9 to about 15 repeats about the flange.

Most preferably, the plates are substantially identical except that the respective relief patterns chirally mirror each other.

In a further aspect of the present invention there is provided an ensemble of stackable servingware including at least a first and second serving article each of which serving articles is of substantially the same size and shape and each of which comprises a central planar portion provided with an upwardly projecting sidewall at the periphery of the central portion and a flange portion projecting outwardly from the sidewall. The first article is provided with a first repeating flange relief pattern including a plurality of first design elements, each of the first design elements including a first terminal relief segment and a second terminal relief segment. The first terminal relief segments extend at least partially into the sidewall of the first article and define a first relief height. The second terminal relief segments extend at least partially into the sidewall of the first article and define a second relief height substantially different from the first relief height of the first terminal segment of the first design element of the first article. The first and second terminal segments are angularly disposed with respect to a plurality of first radial lines about the first serving article bisecting distance between the first and second terminal relief segments of the first design elements of the first article and are symmetric to each other about these first radial lines.

The second article is provided with a second repeating flange relief pattern including a plurality of second design elements each of which includes a third terminal relief segment and a fourth terminal relief segment. The third and fourth terminal relief segments extend at least partially into the sidewall of the second article and define third and fourth relief heights respectively. The third and fourth relief heights are substantially different from each other. The third and fourth terminal segments are also angularly disposed with respect to a plurality of second radial lines about the second article bisecting the distance between the third and fourth terminal segments of the second design elements and are symmetric to each other about these second radial lines.

The third and fourth terminal segments of the second repeating relief flange pattern of the second serving article chirally mirror the spacing, angular and height relationships of the first and second terminal segments of the first repeating flange pattern of the first serving article.

In some embodiments, the first relief heights of the first design elements of the first serving article are substantially equal to the fourth relief heights of the fourth terminal relief segments of the second design elements of the second serving article. In such cases it may also be preferable that the second relief heights of the second terminal relief segments of the first design elements of the first serving article are substantially equal to the third relief heights of the third terminal relief segments of the third design elements of the second serving article.

In particularly preferred embodiments the first repeating flange relief pattern of the second serving article chirally mirrors the first repeating relief pattern of the first serving article and each of the patterns is a plurality of intersecting arcs which appear as an over/under basket-like design. These and other features of the present invention will be more clearly understood by reference to the drawings forming a part of this description.

EXAMPLES

There is shown in FIG. 1 a perspective view of a disposable plate provided with a flange relief pattern. Plate 10 includes a planar central portion 12 coupled to a sidewall portion 14 which projects upwardly therefrom and connects to an outwardly projecting flange portion 16. The flange is provided with a relief pattern 18, which in the embodiment illustrated includes 12 relief arcs 20, 22, 24, 26, 28, 30, 32, 34, 36, 38, 40 and 42. The relief arcs extend at least partially into sidewall portion 14 and are interwoven as shown in a basket weave-like pattern. The relief arcs each have first and terminal segments, such as segments 44, 46 which extend at least partially into sidewall portion 14. Segments 44, 46 have different relief heights as will further be discussed below.

In the embodiment shown in FIG. 1, each of the relief arcs traverses an angular section of approximately 90 degrees of the plate and is symmetrical (in two dimensions) about a radial line bisecting the distance between the terminal segments of the respective arcs. Thus, relief arc 20 is symmetrical about a radial line 48 and arc 24 is symmetrical about a radial line 50 and so forth. There is a slight gap between the arcs as perhaps best seen at 29 on FIG. 1. These gaps help define the pattern of the rings. Particular embodiments may or may not include a gap between design element and segments.

It should be noted that the terminal relief arcs are angularly disposed towards radial lines bisecting them. First terminal segments, such as segment 44, are angularly disposed toward bisecting radial lines, such as bisecting radial line 48, in a clockwise direction as shown while the second terminal segments of the arcs are angularly disposed in the opposite direction. Thus, segment 46 is angularly disposed towards radial line 48 in a counterclockwise direction as shown in FIG. 1. The various configurations are sometimes described herein in terms of clockwise direction; however, it will be appreciated that a corresponding description could be made using the counterclockwise direction as a reference or starting direction.

Figure 2:
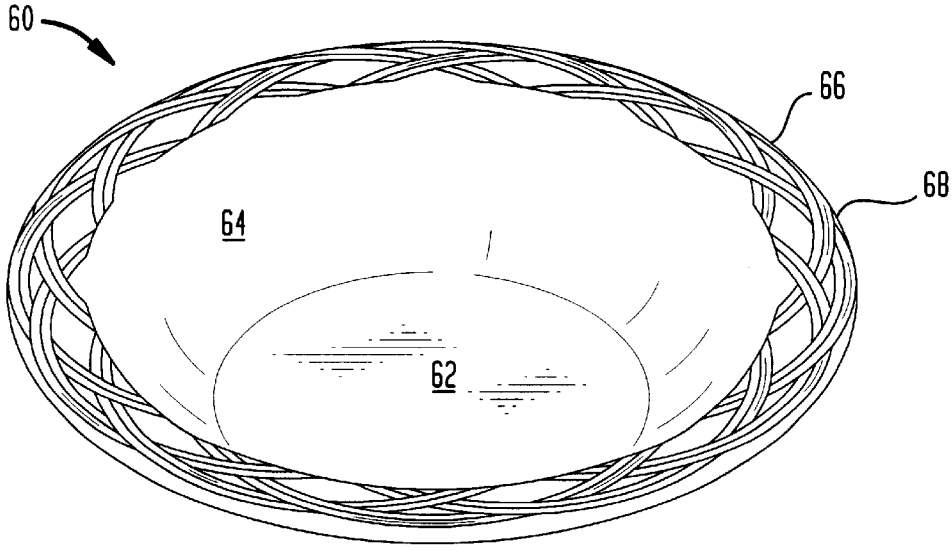
FIG. 2 is a perspective view of a disposable bowl provided with a flange relief pattern in accordance with the invention.

There is shown in FIG. 2 a perspective view of a disposable bowl 60 provided with a flange relief pattern in accordance with the invention. Bowl 60 includes a central portion 62 coupled to a sidewall portion 64 which projects upwardly therefrom to connect to a flange portion 66. The flange is provided with a relief pattern 68 of substantially the same features as was described in connection with plate 10 of FIG. 1.

The cooperation between chirally mirrored flange patterns in accordance with the invention is better understood by reference to FIG. 3(A) through FIG. 6(B) and the examples following.

Figure 3B:
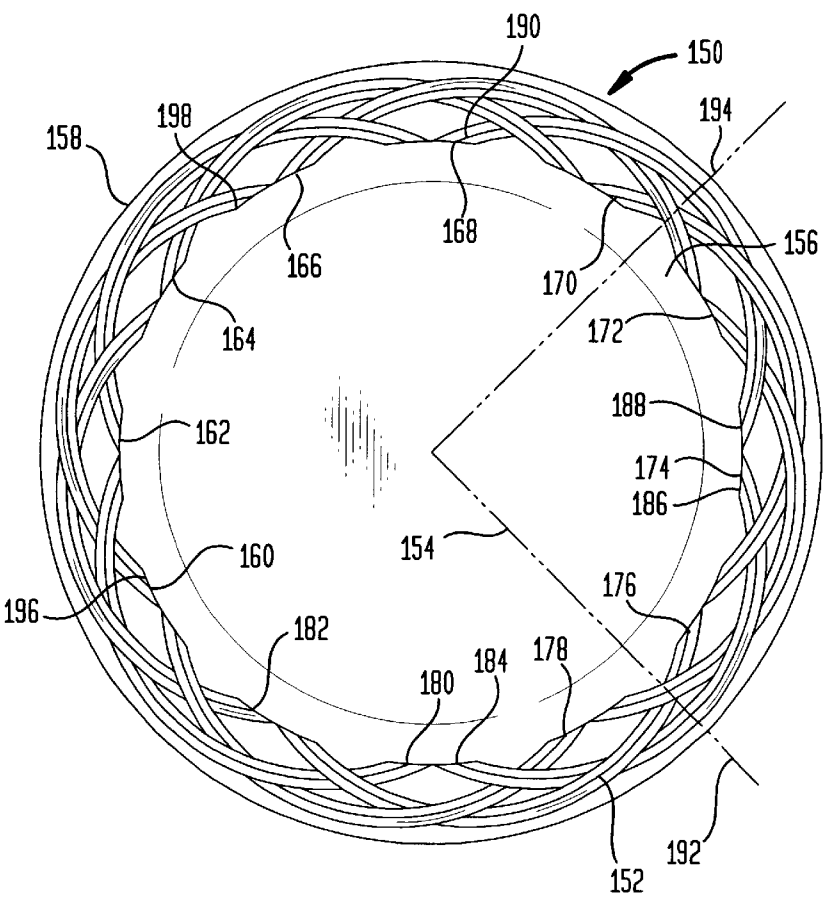
FIG.3(B) is a top plan view of a second plate provided with a second flange relief pattern wherein the second flange relief pattern of FIG. 3(B) chirally mirrors the first flange relief pattern of FIG. 3(A)
Figure 3A:
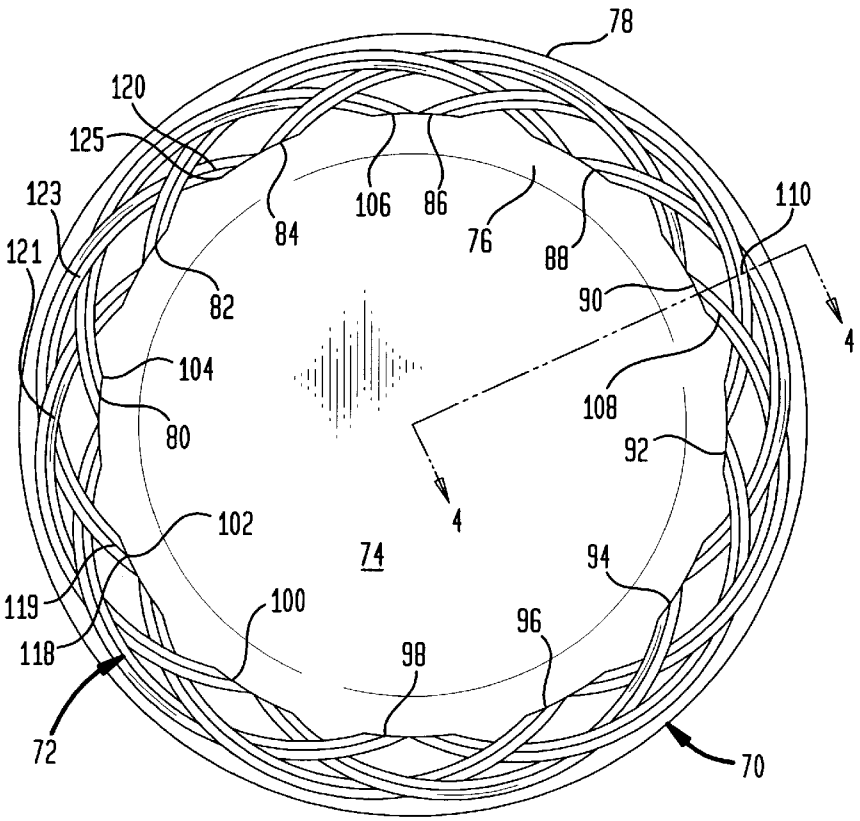
FIG. 3(A) is a top plan view of a first plate provided with a first flange relief pattern in accordance with the invention.

FIG. 3(A) is a top plan view of a disposable plate 70 in this case an 11" diameter plate, provided with a first relief pattern 72 which extends around the plate and consists of 12 arcs or design elements, each of which has terminal segments extending at least partially into the sidewall of the plate. In this respect, plate 70 includes a central portion 74, a sidewall portion 76, as well as a flange portion 78. A plurality of 12 arcs 80, 82, 84, 86, 88, 90, 92, 94, 96, 98, 100, 102 each have terminal relief segments or portions, such as terminal segments 104, 106 of arc 80 which extend at least partially into the upwardly projecting sidewall portion 76 of the plate which can be better appreciated by reference to FIG. 4.

Figure 4:
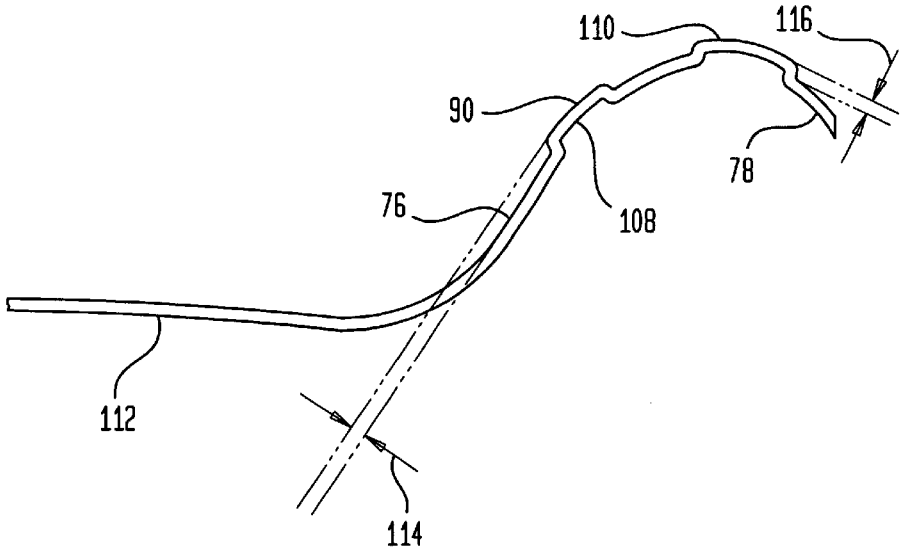
FIG. 4 is a schematic profile of the plate of FIG. 3(A)

FIG. 4 is a profile of plate 70 along line 4—4 showing a terminal segment 108 of relief arc 90, as well as the intersecting relief pattern of two arcs 86, 88 at 110. It should be noted that the central portion of plate 70 may have a slight arch or crown 112 for stability. In the embodiments shown in FIGS. 3(*a*), 3(*b*) and FIG. 4, the plates are generally of uniform wall thickness or caliper of about 20 mils and are most preferably made of mica-filled polypropylene. The relief pattern 72 varies in relief height. Relief height is the height of the vertical wall of the pattern as indicated at 114 and 116 on FIG. 4 and may be thought of as the height (or depth) of the relief pattern from the wall of the plate just adjacent the relief pattern.

A salient feature of the present invention is that the elements of the repeating relief pattern vary in relief height in a unique manner. For example, plate 70 has a relief pattern 72 made up of repeating elements, arcs 80 through 102, which vary in height. There are 12 arcs which repeat every 30 degrees around the plate whose terminal segments vary in height from high to low in a clockwise direction. The arc itself may have an undulatory pattern. Each arc, such as arc 102, has a relief height of approximately 35 mils at terminal segment 118 and has a lower relief height of about 12.5 mils at terminal segment 120. Both terminal segments project into the sidewall area as shown in FIG. 4 and all terminal segments are symmetrical about radial lines of the plate as described in connection with FIG. 1.

In a particularly preferred embodiment, such as that shown in FIGS. 1, 2 and 3, the relief height actually undulates over the length of the relief arc to provide the basket-like appearance of the pattern on the flange. Thus, the relief height is 35 mils at 119, 12.5 mils at 121, 25 mils at 123 and 12.5 mils at 125. A salient feature is the relief height at the terminal segments 118, 120. The relief height of the pattern may indulate between values at the intermediate portions of the relief elements.

FIG. 3(B) is a top plan view of a plate 150 provided with a flange relief pattern which mirrors the flange relief pattern of plate 70 of FIG. 3(A). At first glance, the plates may appear identical; however, it can be seen that the pattern on plate 70 is over/under/over/under in a clockwise direction and the pattern of plate 150 is under/over/under/over in a clockwise direction. For purposes of convenience, the plates of FIG. 3(A) are sometimes referred to as "A" version plates and the plates of FIG. 3(B) are referred to as "B" version plates.

Turning once again to plate 150, plate 150 also comprises a central portion 154, a sidewall portion 156 and a flange portion 158. Pattern 152 comprises 12 arcs 160, 162, 164, 166, 168, 170, 172, 174, 176, 178, 180, 182 overlapping about the periphery of the plate. The pattern thus repeats every 30 degrees and each arc has terminal segments, such as segments 184, 186, 188, 190 which are symmetrical about a plurality of radial lines such as radial lines 192, 194 of the plate as shown in FIG. 3(B). Likewise, the terminal segments project at least partially into sidewall portion 156.

More importantly, the height variation in the relief pattern of plate 150 chirally mirrors that of plate 70. Each arc begins (in a clockwise direction) at a relatively low height and ends (again in a clockwise direction) at a relatively high height.

Thus arc 160 has a relief height of 12.5 mils at 196 and transitions (through intermediate heights in this instance) to a relief height of 35 mils at 198.

With the three-dimensional geometry, the A version plates do not readily nest or lock with B version plates and are advantageously sequentially arranged in a stack, that is, A/B/A/B and so on.

Figure 5A:
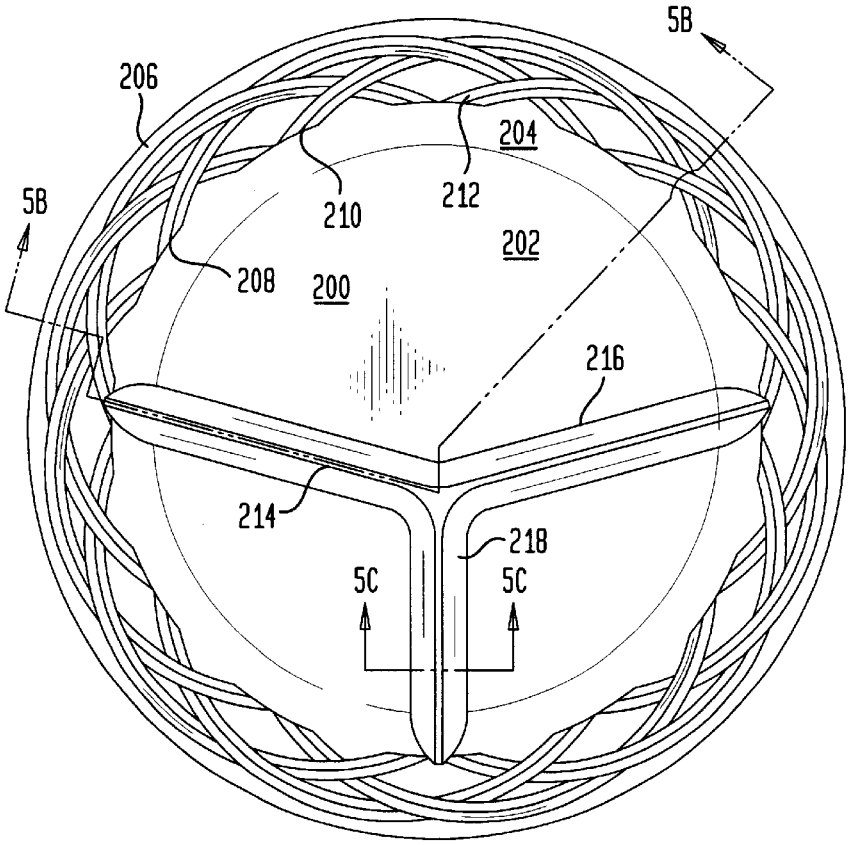
FIG. 5(A) is a plan view of another plate of the present invention.
Figure 5B:
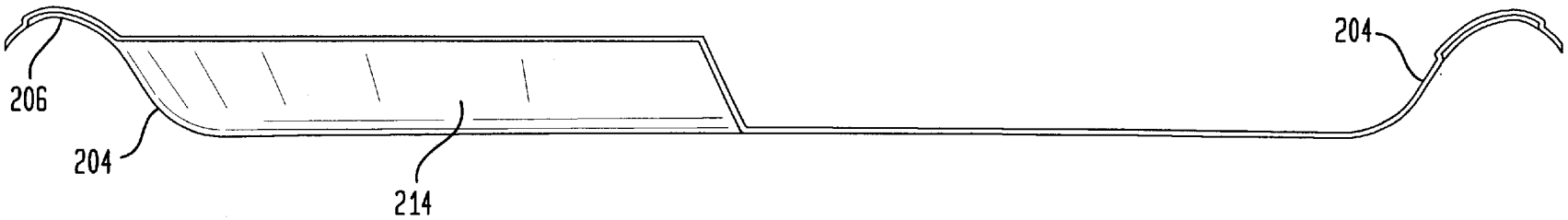
FIG. 5(B) is a view in section along line 5B—5B of FIG. 5(A).
Figure 5C:
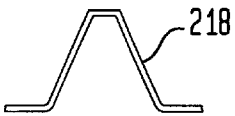
FIG. 5(C) is a view in section along line 5C—5C of FIG. 5(A)

There is shown in FIGS. 5(A) through 5(C) yet another plate 200 of the present invention. Plate 200 includes a central portion 202, a sidewall portion 204 and a flange portion 206 extending outwardly therefrom. The flange portion has a plurality of design elements such as relief design elements 208, 210, 212 and so forth as described in connection with FIGS. 1 through 4. There is additionally provided a series of dividing ribs, 214, 216 and 218 which operate to divide the plate into sections. The present invention is particularly useful in connection with compartmented plates such as that shown in FIGS. 5(A) through 5(C), since plates of this type align in a stack which promotes undesirable nesting. Their feature is better appreciated from the actual stacking experiments which follow.

Figure 6A:
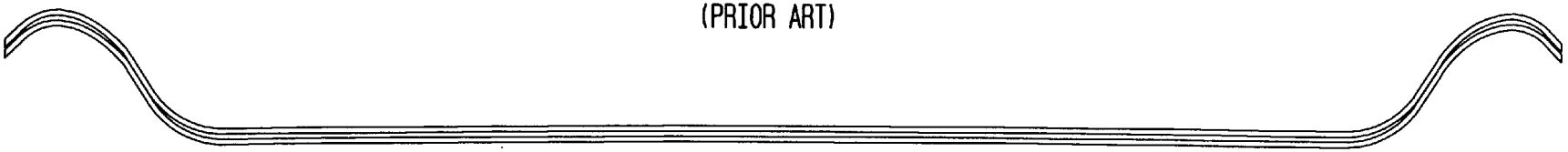
FIG. 6A (PRIOR ART)
FIG. 6(A) is a schematic representation of a stack of plates (prior art) with no flange relief pattern.
Figure 6B:
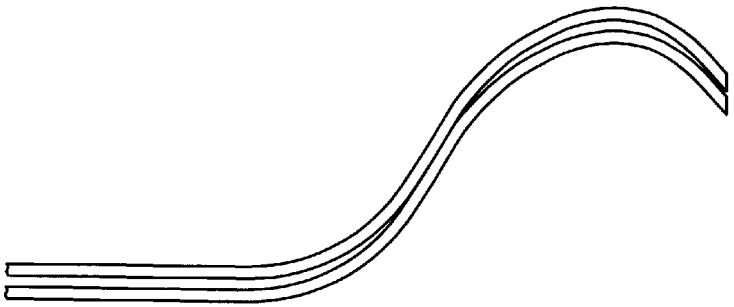
FIG. 6B (PRIOR ART)
FIG. 6(B) is a detail of FIG. 6(A)

The advantages of the invention are perhaps further appreciated by reference to FIGS. 6 and 7. FIGS. 6(A) and (B) are schematic representations of two plates of the general size and shape of plates 70, 150, without a relief pattern. As can be seen, the plates are closely aligned along their profiles and can be assigned an arbitrary product spacing of one unit.

Figure 7A:
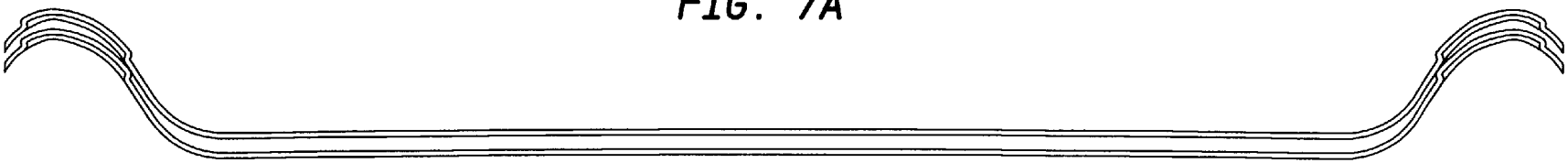
FIG. 7(A) is a schematic representation of a stack of plates provided with flange relief patterns in accordance with the invention wherein the patterns of adjacent plates mirror one another.
Figure 7B:
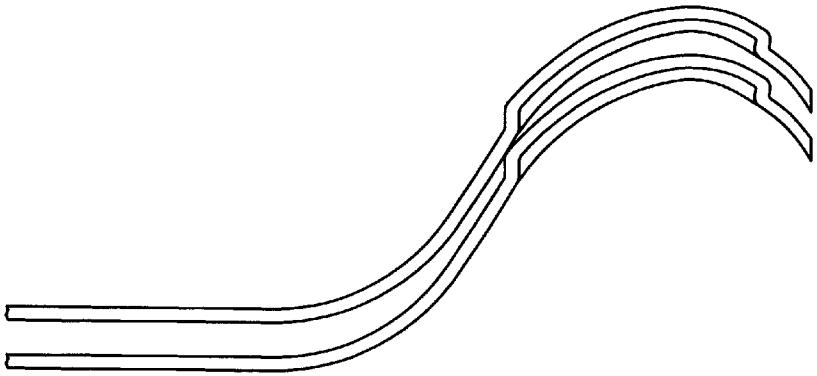
FIG. 7(B) is a detail of FIG. 7(A).

FIGS. 7(A) and 7(B) show the profile of an A version plate stacked adjacent a B version plate. Here, the product spacing is enhanced by the vertical walls at the terminal segments of the relief pattern and the plates exhibit a much greater spacing of 2.2 units based on the arbitrary scale employed in connection with FIGS. 6(A) and 6(B). This result was generally confirmed by the data which follows with some variation believed to be due to the manufacturing of 1 article at a time using different feedstock and so forth.

A series of plates were prepared as described above in both the "A" version and "B" version. The plates were produced with one up prototype tooling. Stack height testing was conducted using a CDI height gauge, model No. BC2110 (one inch range), wherein a heavier plate, such as a plexiglass plate (248 grams) is placed across the plates as a reference measuring plane. Generally this method involves stacking ten plates face down on a flat surface and placing the heavier plate on top of the stack and measuring the height of the stack of plates. Eleven inch plates were tested as enumerated in Tables 1 through 6, wherein the terminology in the tables refers to the following definitions:

Definitions:

"A" Plates: All "A" version flange pattern plates in stack.

"B" Plates: All "B" version flange pattern plates in stack.

"A/B" Plates: "A" and "B" plates alternated in stack

Aligned: Flange patterning aligned directly above each other in stack

Staggered: Flange patterning staggered (15 degrees for current pattern) so do not align directly above each other Random: Plates randomly positioned onto each other so that flange pattern alignment is random "Plates Joined": 1 set of (2) plates frictionally engaged together during plate separation due to taper locking of pattern, vacuum, etc.

Plexiglass plate: Flat plate weighing 248 grams which is placed over the plates for height measurement (standard test).

4.4 lb aluminum plate: Trial flat plate (instead of plexiglass plate) placed over plates to check compression and taper lock tendency at higher weight 11.7 lb steel plate: Trial flat plate (instead of plexiglass plate) placed over plates to check compression and taper lock tendency at higher weight

TABLE 1

1. 11 Inch Noncompartmented Plate - 10 Count Standard Method Stack Heights using 248 gram Plexiglass Plate

| | "A" Plates Aligned | "B" Plates Aligned | "A/B" Plates Aligned | "A" Plates Staggered | "B" Plates Staggered | "A/B" Plates Staggered | "A" Plates Random | "B" Plates Random | "A/B" Plates Random |
|---|---|---|---|---|---|---|---|---|---|
| Stack Heights Ave. | 1.551" Ref. | 1.562" +0.7% | 1.548" −0.2% | 1.533" Ref. | 1.511" −1.4% | 1.613" +5.2% | 1.569" Ref. | 1.565" −0.3% | 1.602" +2.1% |
| Calculated Spacing (Inches) | 0.051" Ref. | 0.052" +2.0% | 0.051" +0% | 0.049" Ref. | 0.046" −6.1% | 0.058" +18.4% | 0.053" Ref. | 0.052" −1.9% | 0.057" +7.6% |

N = 3 plates tested per variable to obtain average
Calculated Spacing = (Stack height (10 plates) − Height (1 plate))/9; Height (1 Plate, "A" or "B" = 1.093")

TABLE 2

11 Inch Compartmented Plated - 10 Count Standard Stack Heights using 248 gram Plexiglass Plate:

| | "A" Plates Aligned | "B" Plates Aligned | "A/B" Plates Aligned |
|---|---|---|---|
| Stack Heights Ave. (Inches) | 1.503" Ref. | 1.511" +0.5% | 1.557" +3.6% |
| Calculated Spacing (Inches) | 0.048" Ref. | 0.049" +2.1% | 0.054" +12.5% |

N = 3 plates tested per variable to obtain average
Calculated Spacing = (Stack Height (10 plates) - Height (1 plate))/9;
Height (1 plate, "A" or "B" = 1.074")

TABLE 3

Noncompartmented Plate - 10 Count Standard Method Stack heights (using 4.4 lb Aluminum Plate)

| | "A" Plates Aligned | "B" Plates Aligned | "A/B" Plates Aligned | "A" Plates Staggered | "B" Plates Staggered | "A/B" Plates Staggered | "A" Plates Random | "B" Plates Random | "A/B" Plates Random |
|---|---|---|---|---|---|---|---|---|---|
| Stack Heights Ave. (Inches) | 1.502" Ref. | 1.520" +1.2% | 1.478" −1.6% | 1.482" Ref. | 1.468" −1.0% | 1.558" +5.1% | 1.499" Ref. | 1.484" _1.0% | 1.525" +1.7% |
| Calculated Spacing (Inches) | 0.045" Ref. | 0.047" +4.4% | 0.043" −4.4% | 0.043" Ref. | 0.042" −2.3% | 0.052" +20.9% | 0.045" Ref. | 0.043" −4.4% | 0.048" +6.7% |

N = 3 plates tested per variable to obtain average
Calculated Spacing = (Stack height (10 plates) − Height (1 plate))/9; Height (1 Plate, "A" or "B" = 1.093")

TABLE 4

Compartmented Plate - 10 Count Standard Stack Heights using 4.4 lb Aluminum Plate:

| | "A" Plates Aligned | "B" Plates Aligned | "A/B" Plates Aligned |
|---|---|---|---|
| Stack Heights | 1.445" | 1.425" | 1.458" |
| Ave. (Inches) | Ref. | −1.4% | 0.9% |
| (Plates Joined) | (7 Sets) | (3 Sets) | (0 Sets) |
| Calculated | 0.041" | 0.039" | 0.043" |
| Spacing (Inches) | Ref. | −4.9% | +4.9% |

N = 3 plates tested per variable to obtain average
Calculated Spacing = (Stack Height (10 plates) - Height (1 plate))/9;
Height (1 plate, "A" or "B" = 1.074")

TABLE 5

Noncompartmented Plate - 10 Count Standard Stack Heights using 11.7 lb Steel Plate

| | "A" Plates Aligned | "B" Plates Aligned | "A/B" Plates Aligned | "A" Plates Staggered | "B" Plates Staggered | "A/B" Plates Staggered | "A" Plates Random | "B" Plates Random | "A/B" Plates Random |
|---|---|---|---|---|---|---|---|---|---|
| Stack Heights Ave. (Inches) | 1.434" Ref. | 1.408" −1.8% | 1.398 −2.5% | 1.430" Ref. | 1.402" −2.0% | 1.483 +3.7% | 1.422" Ref. | 1.414" −0.6% | 1.428" +0.4% |
| (Plates Joined) | (1 Set) | (2 Sets) | (0 Sets) | (0 Sets) | (0 Sets) | (0 Sets) | (1 Sets) | (0 Sets) | (0 Sets) |
| Calculated Spacing (Inches) | 0/038" Ref. | 0.035" −7.9% | 0.034" −10.5% | 0.037" Ref. | 0.034" −8.1% | 0.043" +17.2% | 0.037" Ref. | 0.036" −2.7% | 0.037" +0.0% |

N = 3 plates tested per variable to obtain average
Calculated Spacing = (Stack Height (10 plates) − Height (1 plate))/9; Height (1 plate, "A" or "B" = 1.093")

TABLE 6

Compartmented Plate - 10 Count Standard Stack Heights using 11.7 lb Steel Plate:

| | "A" Plates Aligned | "B" Plates Aligned | "A/B" Plates Aligned |
|---|---|---|---|
| Stack Heights | 1.369" | 1.339" | 1.369" |
| Ave. (Inches) | Ref. | −2.2% | +0.0% |
| (Plates Joined) | (10 Sets) | (11 Sets) | (2 Sets) |

TABLE 6-continued

Compartmented Plate - 10 Count Standard Stack Heights using 11.7 lb Steel Plate:

| | "A" Plates Aligned | "B" Plates Aligned | "A/B" Plates Aligned |
|---|---|---|---|
| Calculated Spacing (Inches) | 0.033" Ref. | 0.029" −12.1% | 0.033" +0.0% |

N = 3 plates tested per variable to obtain average
Calculated Spacing = (Stack Height (10 plates) - Height (1 plate))/9
Height (1 plate, "A" or "B" = 1.074")

Particularly noteworthy from Table 1 is that A/B staggered stacks and A/B random stacks exhibit particularly enhanced spacing and stack heights. The A/B plates in a staggered configuration exhibited more than an 18% increase in calculated spacing as compared to staggered A plates, while the A/B stack in a random configuration exhibited nearly an 8% increase in stack height. This effect is seen in Table 2 for compartmented plates where a stack of A/B plates showed a spacing increase of 12.5% increase over a stack of A plates and a nearly 4 percent increase in stack height.

With the aluminum plate atop the stack, Table 3 shows a nearly 21% increase in spacing for A/B staggered plates with a 5.1% increase in stack height. There is also shown in Table 3 a 1.7% increase in stack height and 6.7% increase in spacing for A/B stacks over A stacks for randomly stacked plates. Likewise, Table 4 shows better spacing for A/B stacked compartmented plates over A plates under heavier load, but more importantly, no A/B plates were stuck together as opposed to A or B stacks.

Tables 5 and 6 relate stacking data for plates under a still heavier load, in these instances an 11.7 lb. steel plate. It can be seen in Table 5 that A plates and B plates alone tended to frictionally join when aligned, whereas a stack of A/B plates did not. Particularly noteworthy in Table 5 is the A/B staggered plates which showed a nearly 4 percent increase in stack height and a 17.2% increase in spacing. For compartmented plates, it is shown in Table 6 that the A/B aligned stack had much less tendency to join with adjacent plates than A or B plates alone. (10 or 11 sets jointed for the single type plate stack vs. 2 for the A/B plate stack.)

While the invention has been described in detail, further modifications will be readily apparent to those of skill in the art, for example, one could employ various patterns which chirally mirror each other within the spirit and scope of the present invention as set forth in the appended claims.

What is claimed is:

1. An ensemble of stackable servingware comprising at least a first and second serving article each of which serving articles is of substantially the same size and shape and each of which comprises a central planar portion provided with an upwardly projecting sidewall at the periphery of said central portion and a flange portion projecting outwardly from said sidewall provided with a relief pattern of varying height, said first article being provided with a first repeating flange relief pattern comprising a plurality of first relief design elements of varying relief height, said plurality of first relief design elements being two-dimensionally symmetrical about a plurality of radial lines about said first article bisecting said first relief design elements;

said second article being provided with a first repeating flange relief pattern comprising a plurality of second relief design elements of varying relief height, said second relief design elements being two-dimentionally symmetrical about a plurality of radial lines about said second article bisecting said second relief design elements;

wherein said second repeating relief pattern chirally mirrors said first repeating relief pattern and said first and second serving articles are configured such that when said first serving article is stacked with said second serving article in a manner that said first repeating relief pattern is aligned with said second repeating relief pattern, corresponding juxtaposed portions of said second repeating relief pattern and said first repeating relief pattern are of substantially different relief heights.

2. The ensemble of stackable articles according to claim 1, wherein said articles have a wall caliper of from about 10 to about 80 mils.

3. The ensemble of stackable articles according to claim 1, wherein said articles have a wall caliper of from about 12 mils to 25 mils.

4. The ensemble of stackable articles according to claim 3, wherein said relief patterns have a relief height of from about 0.25 to about 3 times the wall caliper of said articles.

5. The ensemble of stackable servingware according to claim 4, wherein said relief patterns have a relief height of from about 0.5 to about 2 times the wall caliper of said articles.

6. The ensemble of stackable servingware according to claim 1, wherein said first and second serving articles are plates.

7. The ensemble of stackable servingware according to claim 6, wherein said plates are disposable plates made of paper.

8. The ensemble of stackable servingware according to claim 6, wherein said plates are disposable plates made of plastic.

9. The ensemble of stackable servingware according to claim 8, wherein said plastic is a polystyrene composition or a polypropylene composition.

10. The ensemble of stackable servingware according to claim 9, wherein said composition is a mineral-filled polypropylene composition.

11. The ensemble of stackable servingware according to claim 10, wherein said mineral filled polypropylene composition comprises a mica-filled polypropylene composition.

12. The ensemble of stackable servingware according to claim 1, wherein said first and second serving articles are bowls.

13. The ensemble of stackable servingware according to claim 12, wherein said bowls are disposable bowls made of paper.

14. The ensemble of stackable servingware according to claim 12, wherein said bowls are disposable bowls made of plastic.

15. The ensemble of stackable servingware according to claim 14 wherein said plastic is a polystyrene composition or a polypropylene composition.

16. The ensemble of stackable servingware according to claim 15, wherein said polypropylene composition is a mineral-filled polypropylene composition.

17. The ensemble of stackable servingware according to claim 16, wherein said mineral-filled polypropylene composition is a mica-filled polypropylene composition.

18. The ensemble of stackable servingware according to claim 1, wherein said first relief design elements of varying height vary in relief height from high to low in a clockwise direction and said second relief design elements of varying height vary in relief height from high in a counterclockwise direction.

19. An ensemble of stackable servingware comprising at least a first and a second serving article, each of which serving articles is of substantially the same size and shape and each of which comprises a central planar portion provided with an upwardly projecting sidewall at the periphery of said central portion and a flange portion projecting outwardly from said sidewall, said first article being provided with a first repeating flange relief pattern comprising a plurality of first arcuate design elements, each of said first arcuate design elements including a first terminal relief segment and a second terminal relief segment;

said first terminal relief segments extending inwardly at least partially into said sidewall of said first article and defining a first relief height;

said second terminal relief segments extending inwardly at least partially into said sidewall of said first article and defining a second relief height substantially different from said first relief height of said first terminal segment of said first design element of said first article;

wherein said first and second terminal segments are angularly disposed with respected to a plurality of first radial lines about said first serving article bisecting the distance between said first and second terminal segments of said first design elements of said first article and said arcuate design elements are two-dimentionally symmetrical about said first radial lines;

said second article being provided with a second repeating flange relief pattern comprising a plurality of second arcuate design elements, each of said second arcuate design elements including a third terminal relief segment and a fourth terminal relief segment;

said third terminal relief segments extending inwardly at least partially into said sidewall of said second article and defining a third relief height;

said fourth terminal relief segments extending at least partially into said sidewall of said second article and defining a fourth relief height substantially different from said third relief height of said third terminal segment of said second design elements of said second article;

wherein said third and fourth terminal segments are angularly disposed with respect to a plurality of said radial lines about said second article bisecting the distance between said third and fourth terminal segments of said second arcuate design elements of said second article and said second arcuate design elements are two-dimensional symmetrical about said second radial lines;

wherein further said second arcuate design elements of said second repeating relief flange pattern of said second serving article chirally mirror the spacing, angular and height relationships of said first arcuate design elements of said first repeating flange relief pattern of said first serving article and said first and second serving articles are configured such that when said first serving article is stacked with said second serving article in a manner that said first repeating relief pattern is aligned with said second repeating relief pattern, corresponding juxtaposed portions of said second repeating relief pattern and said first repeating relief pattern are of substantially different relief heights.

20. The ensemble of stackable servingware according to claim 19, wherein said first repeating flange relief pattern of said first article and said second repeating flange pattern of said second article comprise a series of overlapping arcuate design elements of varying height configured to appear as an over/under basket weave design.

21. The ensemble of stackable servingware according to claim 19, wherein said arcuate design elements repeat from about 6 times to about 24 times around the flange.

22. The ensemble of stackable articles according to claim 21, wherein said arcuate design elements repeat from about 9 to about 15 times about the flange.

23. The ensemble of stackable servingware according to claim 19, wherein said second repeating flange relief pattern of said second serving article chirally mirrors said first repeating flange relief pattern of said first serving article.

24. The ensemble of stackable servingware according to claim 19, wherein said first and second serving articles are plates.

25. The ensemble of stackable servingware according to claim 24, wherein said plates are disposable plates made of paper.

26. The ensemble of stackable servingware according to claim 24, wherein said plates are disposable plates made of plastic.

27. The ensemble of stackable servingware according to claim 26, wherein said plastic is a polystyrene composition or a polypropylene composition.

28. The ensemble of stackable servingware according to claim 27, wherein said composition is a mineral-filled polypropylene composition.

29. The ensemble of stackable servingware according to claim 28, wherein said mineral-filled polypropylene composition comprises a mica-filled polypropylene composition.

30. The ensemble of stackable servingware according to claim 19, wherein said first and second serving articles are bowls.

31. The ensemble of stackable servingware according to claim 30, wherein said bowls are disposable bowls made of paper.

32. The ensemble of stackable servingware according to claim 30, wherein said bowls are disposable bowls made of plastic.

33. The ensemble of stackable servingware according to claim 32, wherein said plastic is a polystyrene composition or a polypropylene composition.

34. The ensemble of stackable servingware according to claim 33, wherein said polypropylene composition is a mineral-filled polypropylene composition.

35. The ensemble of stackable servingware according to claim 34, wherein said mineral-filled polypropylene composition is a mica-filled polypropylene composition.

36. The ensemble of stackable articles according to claim 19, wherein said articles have a wall caliper of from about 12 to about 25 mils.

37. The ensemble of stackable articles according to claim 36, wherein said relief segments have a relief height of from about 0.25 to about 3 times the wall caliper of said articles.

38. The ensemble of stackable articles according to claim 37, wherein said relief segments have a relief height of from about 0.5 to bout 2 times the wall caliper of said articles.

39. The ensemble of stackable articles according to claim 36, wherein said articles have a wall caliper of about 20 mils and wherein said first relief height of said first terminal relief segments of said first arcuate design elements and said fourth relief heights of said fourth terminal relief segments of said second arcuate design elements have a relief height of about 0.025 inches and wherein further said second relief height of said second terminal relief segments of said first arcuate design elements and said third relief heights of said third terminal relief segments of said second arcuate design elements have a relief height of about 0.0125 inches.

40. The ensemble of stackable articles according to claim 36, wherein said articles have a wall caliper of about 20 mils and wherein said first relief heights of said first terminal relief segments of said first arcuate design elements and said fourth relief heights of said fourth terminal relief segments of said second arcuate design elements have a relief height of about 0.035 inches and wherein further said second relief heights of said second terminal relief segments of first arcuate design elements and said third relief heights of said third terminal relief segments of said second arcuate design elements have a relief height of about 0.0125 inches.

41. An ensemble of stackable servingware comprising at least first and second serving articles each of which serving article is substantially the same size and shape and each of which comprises a central planar portion provided with an upwardly projecting sidewall at the periphery of said central portion and a flange portion projecting outwardly from said sidewall, said first article being provided with a first repeating flange relief pattern comprising a plurality of first design elements each of said first design elements including a first terminal relief segment and a second terminal relief segment;

said first terminal relief segments extending at least partially into said sidewall of said first article and defining a first relief height;

said second terminal relief segments extending at least partially into said sidewall of said first article and defining a second relief height substantially different from said first relief height of said first terminal segment of said first design element of said first article;

wherein said first and second terminal segments are angularly disposed with respect to a plurality of first radial lines about said first serving article bisecting the distance between said first and second terminal segments of said first design elements of said first article and are two-dimensionally symmetrical about said first radial lines;

said second article being provided with a second repeating flange relief pattern comprising a plurality of second design elements, each of said second design elements including a third terminal relief segment and a fourth terminal relief segment;

said third terminal relief segments extending at least partially into said sidewall of said second article and defining a third relief height;

said fourth terminal relief segments extending at least partially into said sidewall of said second article and defining a fourth relief height substantially different from said third relief height of said third terminal segment of said second design elements of said second article;

wherein said third and fourth terminal segments are angularly disposed with respect to a plurality of second radial lines about said second article bisecting the distance between said third and fourth terminal segments of said second design elements of said second article and are two-dimensionally symmetrical to each other about said second radial lines and;

wherein further, said third and fourth terminal segments of said second repeating relief flange pattern of said second serving article chirally mirrors the spacing, angular and height relationships of said first and second terminal segments of said first repeating flange pattern of said first serving article and said first and second serving articles are configured such that when said first serving article is stacked with said second serving article in a manner that said first repeating relief pattern is aligned with said second repeating relief pattern, corresponding juxtaposed portions of said second repeating relief pattern and said first repeating relief pattern are of substantially different relief heights.

42. The ensemble of stackable servingware according to claim 41, wherein said first relief height of said first terminal relief segments of said first design elements of said first serving article are substantially equal to said fourth relief height of said fourth terminal relief segments of said second design elements of said second serving article.

43. The ensemble of stackable servingware according to claim 41, wherein said second relief height of said second terminal relief segments of said first design elements of said first serving article are substantially equal to said third relief height of said third terminal relief segments of said second design elements of said second serving article.

44. The ensemble of stackable servingware according to claim 41, wherein said first relief height of said first terminal relief segments of said first design elements of said first serving article are substantially equal to said fourth relief height of said fourth terminal relief segments of said second design elements of said second serving article and wherein said second relief height of said second terminal relief segments of said first design elements of said first serving article are substantially equal to said third relief height of said third terminal relief segments of said second design elements of said second serving article.

45. The ensemble of stackable servingware according to claim 41, wherein said second repeating flange relief pattern of said second serving article chirally mirrors said first repeating flange relief pattern of said first serving article.

46. The ensemble of stackable servingware according to claim 45, wherein said flange relief patterns comprise a plurality of intersecting arcs of varying height.

* * * * *